US005842389A

United States Patent [19]

Halstead

[11] Patent Number: 5,842,389

[45] Date of Patent: Dec. 1, 1998

[54] ADAPTABLE NAIL SET

[76] Inventor: Michael Halstead, 469 Willow Grove Rd., Stony Point, N.Y. 10980

[21] Appl. No.: 936,249

[22] Filed: Sep. 24, 1997

[51] Int. Cl.[6] ..... B25C 3/00

[52] U.S. Cl. ..... 81/44; 81/177.2

[58] Field of Search ..... 81/44, 487, 177.1, 81/177.2, 177.5, 124.4

[56] References Cited

U.S. PATENT DOCUMENTS

| | | | |
|---|---|---|---|
| D. 25,308 | 3/1896 | Neff | 81/44 |
| D. 33,792 | 12/1900 | Adkins | 81/44 |
| 1,264,904 | 5/1918 | De Stefan | 81/44 |
| 1,495,092 | 5/1924 | Makowski | 81/44 |
| 2,282,148 | 5/1942 | Mandl | 81/177.2 |
| 2,577,954 | 12/1951 | Di Pietro | 81/44 |
| 4,856,387 | 8/1989 | Gibson | 81/124.4 |
| 5,477,758 | 12/1995 | Cunningham | 81/177.2 |

*Primary Examiner*—David A. Scherbel
*Assistant Examiner*—Joni B. Danganan
*Attorney, Agent, or Firm*—Stanley J. Yavner

[57] ABSTRACT

An adaptable nail set is disclosed to include a common nail set, to which is welded a perpendicularly oriented shaft. At the end of the shaft remote from the nail set is attached, by a screw-thread or snap-in construction, a remote handle for use by the carpenter. The remote handle provides the function of separating the carpenter's hand from the nail set, in order to protect the carpenter from the point of contact between a hammer and the nail set. In this regard, the shaft is designed to present an elongation approximately equal to the size of a standard hammer, considered to be the length to offer the best protection for the carpenter. The weld connection between the shaft and the nail set functions to withstand the forces applied by the hammer to the nail set, when in use, in order to avoid the direct and twisting forces that would be applied to another type of connection between the shaft and the nail set.

5 Claims, 1 Drawing Sheet

10
10'
10''
10'''
12
14
14a
14b
16
18
20
22
24
26
28
30
32
2
4

ADAPTABLE NAIL SET

FIELD OF THE INVENTION

This invention relates primarily to carpentry tools and more particularly to nail set structures, a part of which is interchangeable to vary the size thereof.

BACKGROUND OF THE INVENTION

Nail sets have been a staple tool of the carpenter for decades; but they have suffered from the disadvantage that the common nail set is of a single size, insofar as the portion thereof that contacts the head of the nail in order to set the nail below the surface of the wood into which it is driven. Furthermore, a nail set is commonly held by the carpenter approximately midway of the elongated body thereof, using primarily the carpenter's thumb and forefinger for the purpose of positioning the nail set on the nail head and for impact by a hammer to set the nail in place. Of course, such positioning for use presents the dangerous possibility, as with driving a nail with a hammer, that the hammer will impact the carpenter's thumb or forefinger.

In terms of varying the size of the nail set, particularly, U.S. Pat. No. 1,495,092, issued to Makowski on May 20, 1924, offered the solution in a structure whereby a pair of nail sets were arranged at either end of a connecting bar, each of the nail sets being sized for a nail head of a different diameter. Furthermore, the connecting bar for Makowski's two nail sets presents a structural facility, in the form of a dished holding portion for the carpenter's thumb or finger during the nail-setting operation.

It is therefore seen that Makowski has provided some solution for the two problems presented above; namely, the size variation problem for the nail set and the problem relating to the danger of the hammer used in the nail set operation, impacting the carpenter's hand. As far as the variation of size aspect, Makowski has presented only a variation amounting to a single change of the standard nail set size. As far as the aspect relating to impacting the carpenter's hand with the hammer, the difference between the hammer length and the connecting bar length of Makowski is great enough, so as to minimally alleviate the danger.

Also, Makowski suggests that the connecting bar of his structure be arranged so that it "merges with" the structure of the nail set proper. In terms of the present invention, two advantages are offered in joining the shaft (somewhat equivalent to Makowski's connecting bar) with the nail set proper by the use of a weld; firstly, the weld offers a flexibility making it less likely for the connection to fail, and, economy of cost of the structure is presented by the present invention, whereby readily available nail sets can be purchased by the carpenter or used by the manufacturer, for joining with the shaft by a weld according to the present invention.

OBJECTS AND SUMMARY OF THE PRESENT INVENTION

Accordingly, a primary object of the present invention is to provide a nail set structure adaptable to accommodate a number of nail sets of different sizes;

A further object of the present invention is to provide a nail set structure for accommodating various sized nail sets and removing the nail sets from the holding position of the user thereof in order to prevent the danger of injury when a hammer impacts the head of the nail set;

A still further object of the present invention is to provide a nail set structure as above described wherein the shaft thereof is positioned with a welded nail set at one end and a removably handle at the other end, the overall size of the nail set structure being approximately the length of a standard hammer; and Another object of the present invention is to provide a nail set structure for use with interchangeable nail set sizes, and with a removable handle enabled by a connecting screw thread, a snap-on handle, or the like.

Other objects and advantages of the present invention are accomplished in a nail set structure which features an elongated shaft, approximating the length of a hammer at the end of which is welded a nail set of a particular size. At the other end of the shaft is a handle, joined to the shaft with a ready removal capability, such as snap-on or screw-type. The shaft is joined to the nail set by a weld and the present invention offers the capability of use with other sized nail sets, by simply removing the combination of the shaft and the nail set, and replacing it with a shaft-nail set combination for screw-in or snap-on to the handle, which presents a different sized nail set.

DETAILED DESCRIPTION OF THE PREFERRED AND AN ALTERNATIVE EMBODIMENT

Other objects, features and advantages of the present invention are provided in the following detailed description of the preferred, but nonetheless illustrative, embodiment of the present invention, with reference to the accompanying drawing, wherein.

Figures 1, 2, 3, 4:
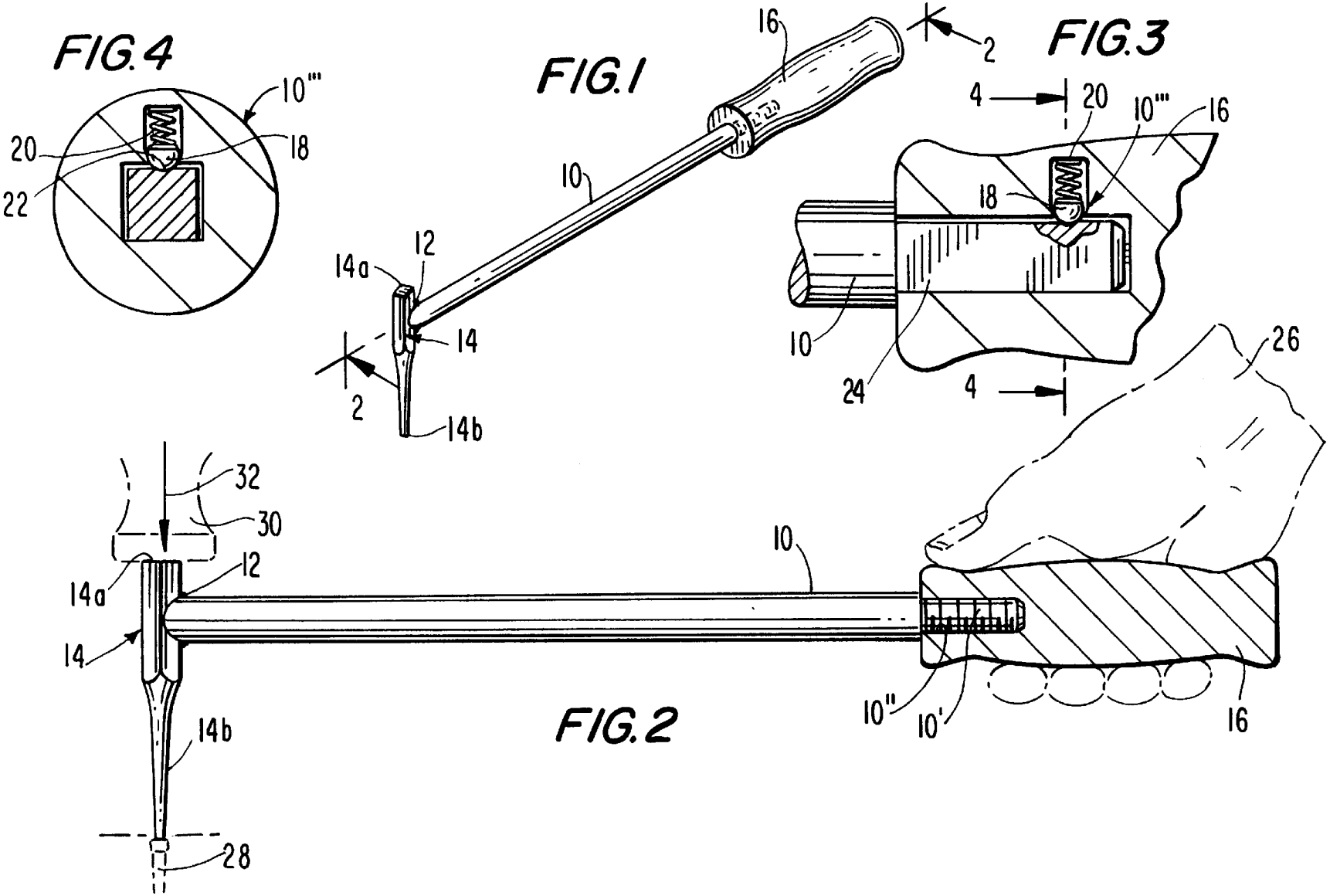
FIG. 1 is an isometric view of the present invention, showing the shaft, the nail set of chosen size, welded to one end thereof, and the handle at the other end thereof, joined by screwing the connecting bar therein.
FIG. 2 is a side view of the structure of the present invention, showing the holding of the structure by the carpenter during use, as a hammer impacts the nail set for lowering the nail below the surface of the wood.

FIG. 3 shows, in exploded view, a partial representation of the handle, showing particularly an alternative form for joining the shaft to the handle by use of a snap-on connection; thereby to provide, as with the screw-on embodiment, a feature enabling the changing of the combination shaft-nail set to enable use of a nail set of a different size; and FIG. 4 is a sectional view, taken along the line 4—4 of FIG. 3, and showing the holding capability of the spring-loaded snap for connecting the handle and the connecting bar, during use thereof; as well as showing the rounded snap to enable easy removability when the size of the nail set is to be changed.

Referring to the drawings, a nail set structure of the present invention is shown to include an elongated shaft 10, attached at one of its ends by a weld 12 to a nail set generally designated 14, having nail set head 14*a* and a nail contact portion 14*b*. At the other of the ends of shaft 10, a handle 16 is screwed thereon. The attachment of shaft 10 to handle 16 is accomplished (FIGS. 1 and 2) by means of screw threaded portion 10' screwable to matching threads 10" in a bore of handle 16. As may be seen most clearly by the proportions offered in the representation of FIG.2, the overall length of the nail set structure of the present invention, in the direction of elongation of shaft 10, is approximately the length of a standard hammer.

FIGS. 3 and 4 show a means for attachment of shaft 10 to handle 16, as an alternate to that shown in FIGS. 1 and 2.

The alternative involves the use of a snap-on structure, generally designated 10'''. The snap-on structure includes rounded snap 18 loaded by spring 20, so that it is biased toward an indentation 22 defined by end portion 24 projecting from the end of shaft 10.

In order to provide a more complete description of the present invention, both in terms of its preferred and alternative embodiments, a complete set of use steps is now provided. The user of the nail set structure, according to the present invention, for instance, a carpenter, chooses the size of the nail set 14 to be used, depending upon, usually, the size of the nail to be set. Once chosen, the shaft-nail set, welded combination is screwed into handle 16 or snapped therein, using the alternative shown in FIGS. 3 and 4. The carpenter then places his hand 26 in the position shown in FIG. 2, with nail contact portion 14*b* in contact with nail 28. With the carpenter's other hand, he or she then brings down hammer head 30 in the direction of arrow 32 to set nail 28.

In this manner, hand 26 is removed from the impact of hammer 30 by a distance approximately equal to the length of a common hammer. Furthermore, if other nails are to be set, the change-over to other sized nail sets 14 is accomplished by a simple removal of handle 16 (unscrewed or snapped out), with a new shaft 10 welded to a different sized nail set 14 screwed in or snapped in to the same handle 16. In terms of structural efficacy, it should be again noted that weld 12, for connecting shaft 10 with nail set 14, presents a connection that is both flexible, and yet strong enough to withstand the consistent impacting by hammer 30.

The foregoing description is not to be considered as a limitation on the breadth of the present invention; but, instead, the present invention is to be accorded the full breadth and scope of the following claims.

What is claimed is:

1. A nail set structure comprising: an elongated shaft having first and second ends, a handle removably attached to said first end of said shaft, a nail set, and a weld attaching said shaft to said nail set at said second end so that the distance of said handle from said nail set is approximately the length of a hammer.

2. The invention according to claim 1, wherein said nail set is elongated in a direction perpendicular to the direction of elongation of said shaft.

3. The invention according to claim 1, wherein said shaft defines an indentation at its first end and said handle includes a spring biased snap and defines a bore, in which said snap is located, said snap for protruding into said indentation.

4. The invention according to claim 3, wherein said snap is rounded.

5. The invention according to claim 1, wherein said shaft includes a threaded portion at said first end and said handle includes threads for mating with said threaded portion.

* * * * *